US010040124B2

(12) United States Patent
Jurczakowski et al.

(10) Patent No.: US 10,040,124 B2
(45) Date of Patent: Aug. 7, 2018

(54) METHOD OF PREPARING PURE PRECIOUS METAL NANOPARTICLES WITH LARGE FRACTION OF (100) FACETS, NANOPARTICLES OBTAINED BY THIS METHOD AND THEIR USE

(71) Applicant: UNIWERSYTET WARSZAWSKI, Warsaw (PL)

(72) Inventors: Rafal Jurczakowski, Brwinow (PL); Justyna Piwowar, Warsaw (PL); Barbara Gralec, Ozarow (PL); Adam Lewera, Warsaw (PL)

(73) Assignee: Uniwersytet Warszawski, Warsaw (PL)

( * ) Notice: Subject to any disclaimer, the term of this patent is extended or adjusted under 35 U.S.C. 154(b) by 365 days.

(21) Appl. No.: 14/784,097

(22) PCT Filed: Jul. 3, 2014

(86) PCT No.: PCT/IB2014/062831
§ 371 (c)(1),
(2) Date: Oct. 13, 2015

(87) PCT Pub. No.: WO2014/162308
PCT Pub. Date: Oct. 9, 2014

(65) Prior Publication Data

US 2016/0082515 A1 Mar. 24, 2016

(30) Foreign Application Priority Data

Feb. 14, 2014 (PL) ..... 407178

(51) Int. Cl.
*B22F 9/24* (2006.01)
*B22F 1/00* (2006.01)
*C22B 3/00* (2006.01)

(52) U.S. Cl.
CPC ..... *B22F 9/24* (2013.01); *B22F 1/0018* (2013.01); *C22B 11/04* (2013.01)

(58) Field of Classification Search
None
See application file for complete search history.

(56) References Cited

U.S. PATENT DOCUMENTS 9,221,044 B2 * 12/2015 Jurczakowski ..... B22F 1/0018
9,388,477 B1 * 7/2016 Sun ..... B01J 23/42
(Continued)

FOREIGN PATENT DOCUMENTS

WO 2013186740 A1 12/2013

OTHER PUBLICATIONS

Temer S. Ahmadi et al. "Shape-Controlled Synthesis of Colloidal Platinum Nanoparticles", Science, New Series, vol. 272, No. 5270, pp. 1924-1926 (Jun. 1996).
(Continued)

*Primary Examiner* — George Wyszomierski
(74) *Attorney, Agent, or Firm* — Browdy and Neimark, P.L.L.C.

(57) ABSTRACT

The invention provides a method of preparing pure precious metal nanoparticles of controlled sizes and having (100) facets, wherein a precursor substance contained in a reagent solution is subjected to a reduction reaction using a reducing agent contained in the reagent solution to provide nanoparticles, and the reduction reaction is stopped by rapid lowering of the reaction solution temperature. In the process of the invention, the need to use surfactants or other organic particles to stabilize the (100) facets is eliminated.

17 Claims, 2 Drawing Sheets

(56) References Cited

U.S. PATENT DOCUMENTS

| | | | | |
|---|---|---|---|---|
| 2004/0099092 | A1* | 5/2004 | Harutyunyan | B22F 1/0018 75/343 |
| 2006/0073667 | A1* | 4/2006 | Li | B22F 1/0018 438/311 |
| 2009/0148600 | A1* | 6/2009 | Li | B22F 1/0022 427/256 |
| 2011/0256469 | A1 | 10/2011 | Tong et al. | |
| 2014/0065437 | A1* | 3/2014 | Wong | B82Y 30/00 428/615 |

OTHER PUBLICATIONS

J, Baumgard et al.,"Application of microstructured devices for continuous synthesis of tailored platinum nanoparticles", Chemical Engineering Journal, pp. 137-144, vol. 227 (Aug. 2012).

K.R. Beyerlein et al.,"Characterization of (111) surface tailored Pt nanoparticles by electrochemistry and X-ray powder diffraction", Materials Science and Engineering A, pp. 83-90, vol. 528, (May 2010).

Jingyi Chen et al.,"Polyol Synthesis of Platinum Nanostructures: Control of Morphology through the Manipulation of Reduction Kinetics", Angew. Chem. Int. Ed., pp. 2589-2592, vol. 44 (Mar. 2005).

Jingyi Chen et al.,"Single-Crystal Nanowires of Platinum Can Be Synthesized by Controlling the Reaction Rate of a Polyol Process", American Chemical Society, pp. 10854-10855, vol. 126, (Aug. 2004).

B.E. Conway et al.,"Ultrapurification of Water for Electrochemical and Surface Chemical Work by Catalytic Pyrodistillation", Analytical Chemistry, pp. 1331-1336, vol. 45, No. 8 (Jul. 1973)

Thurston Herricks et al.,"Polyol Synthesis of Platinum Nanoparticles: Control of Morphology with Sodium Nitrate",Nano Letters, pp. 2367-2371, vol. 4, No. 12 (Sep. 2004).

John N. Kuhn et al.,"Effect of organic capping layers over monodisperse platinum nanoparticles upon activity for ethylene hydrogenation and carbon monoxide oxidation", Journal of Catalysis, pp. 209-215, vol. 265, (May 2009).

J. Monzo et al.,"Removing Polyvinylpyrrolidone from Catalytic Pt Nanoparticles without Modification of Superficial Order", ChemPhysChem, pp. 709-715, vol. 13 (Jan. 2012).

Krisztian Niesz et al.,Precise Control of the Pt Nanoparticle Size by Seeded Growth Using EO13PO30EO13 Triblock Copolymers as Protective Agents, Nano Letters, pp. 2238-2240, vol. 5, No. 11, (Aug. 2005).

Masateru Nishioka et al.,"Rapid and Continuous Polyol Process for Platinum Nanoparticle Synthesis Using a Single-mode Microwave Flow Reactor", Chemical Letters, pp. 1327-1329, vol. 40 (Aug. 2011).

A. Pyatenko et al.,"Synthesis of silver nanoparticles by laser ablation in pure water", Applied Physics A, pp. 803-806, vol. 79 (Jul. 2004).

J. Solla-Gullon et al.,"Electrochemical and electrocatalytic behaviour of platinum-palladium nanoparticle alloys", Electrochemistry Communications, pp. 716-721, vol. 4 (Jul. 2002).

J. Solla-Gullon et al.,"Electrochemical characterisation of platinum nanoparticles prepared by microemulsion: how to clean them without loss of crystalline surface structure", Journal of Electroanalytical Chemistry, pp. 69-77, vol. 491 (Mar. 2000).

J. Solla-Gullon et al., "Electrochemical characterisation of platinum-palladium nanoparticles prepared in a water-in-oil microemulsion", Journal of Electroanalytical Chemistry, pp. 273-284, vol. 554 (Mar. 2003).

J. Solla-Gullon et al.,"Synthesis and Electrochemical Decontamination of Platinum-Palladium Nanoparticles Prepared by Water-in-Oil Microemulsion", Journal of The Electrochemical Society, pp. E104-E109, vol. 150, No. 2, (Jan. 2003).

Hyunjoon Song et al.,"Pt Nanocrystals: Shape Control and Langmuir-Blodgett Monolayer Formation", J. Phys. Chem. B, pp. 188-193, vol. 109, No. 1, (Dec. 2004).

Mami Yamada et al.,"Synthesis and Size Control of Pt Nanocubes with High Selectivity Using the Additive Effect of NaI", Chemistry Letters, pp. 1050-1051, vol. 34, No. 7, (Apr. 2005).

Aneta Januszewska et al., "Outstanding Catalytic Activity of Ultra-Pure Platinum Nanoparticles" Chemistry—A European Journal, pp. 17159-17164, vol. 19. No. 50 (Dec. 9, 2013.

I.S. Helgadottir et al, "Synthesis of bimetallic nanoparticles in ionic liquids: Chemical routes vs physical vapor deposition" Microelectronic Engineering, pp. 229-232, vol. 107, (Jul. 1, 2013).

Hideya Kawasaki, Surfactant-free solution-based synthesis of metallic nanoparticles toward efficient use ofthe nanoparticles surfaces and their application in catalysis and chemo-/biosensingn, Nanotechnology Reviews, , pp. 5-25, vol. 2, No. 1, (Jan. 19, 2013).

* cited by examiner

METHOD OF PREPARING PURE PRECIOUS METAL NANOPARTICLES WITH LARGE FRACTION OF (100) FACETS, NANOPARTICLES OBTAINED BY THIS METHOD AND THEIR USE

The invention provides a method of preparing of pure precious metal nanoparticles with the (100) facets, nanoparticles prepared by said method and use thereof.

Methods of nanoparticle synthesis based on reduction of precious metal compounds are commonly known and implemented in practice. The most popular methods, which allow to obtain nanoparticles (e.g. platinum) without any support (i.e. not supported on another material), employ chemical reduction of platinum salts or complexes in an environment containing a reducing agent, and substances controlling the size of the forming nanoparticles. For example, Pt(II) or Pt(IV) compounds are reduced with alcohols, and ethylene glycol [1-6], hydrazine [7,8] or sodium borohydride [9]. Size control is achieved by adding organic compounds (surfactants) adsorbing strongly on the surface of nascent nanoparticles, such as PVP (polyvinylpyrrolidone) or other strongly adsorbing polymers [1-11].

However, the majority of synthesis methods employed nowadays do not allow to control size of the formed nanoparticles, without addition of substances strongly adsorbing on surfaces of the formed nanoparticles (surfactants). The surface of such obtained nanoparticles is contaminated with surfactants or products of their degradation, which makes possibilities of their use limited, due to the drop in catalytic activities and necessity to employ procedures for purification of the obtained nanoparticles. Numerous methods for purification were developed based on chemical or electrochemical oxidation of the adsorbed surfactant [7, 8, 10, 12]. Electrochemical purification is based on cycling of electric potential of a nanoparticle-containing electrode between the values selected to oxidize the adsorbed surfactant. Said potential is of the order of platinum oxide formation, or even oxygen evolution potential. The potential cycling lasts long enough to reach a constant current response of the system. However, it should be emphasized that electrochemical purification is unpractical for larger batches of the material, as the electric contact of every nanoparticle with the electrode must be ensured. The method is usually employed for very small batches of the material deposited as a thin layer on the electrode.

The method of chemical purification employs strong oxidizing agents, such as potassium permanganate, potassium dichromate etc. Nanoparticles are subjected to oxidizing action of an oxidizing agent solution. Due to their oxidative properties, use of such materials requires great care, and purification of even small batches of nanoparticles requires substantial amounts of the oxidizing agent, which is detrimental for both persons in charge of the process, and for the environment [13].

It should be also noted that it is not certain that the purification procedure allows for complete purification of the nanoparticle surfaces from the surfactant or its decomposition products. In certain circumstances, (at least partial) purification of the surface [10, 12] can be achieved, however, the amount of the surfactant removed cannot be determined without additional examination. It was also shown that the methods of nanoparticle surface purification, which employ a procedure of oxidation of the adsorbed surfactant lead to formation of elemental carbon deposits on the surface. Such residues block catalyst's surface, are practically impossible to remove and very hard to detect [14].

Moreover, the methods of purification, which employ oxidation of the adsorbed surfactant, allow for (partial) purification of the most precious metals only (such as e.g. platinum), nanoparticles of the other ones (e.g. palladium) will dissolve under such treatment.

The advantages of using surfactants (e.g., PVP) include the fact that their employment, due to their strong interaction with surfaces of the formed nanoparticles, results in obtaining preferential crystallographic domains at nanoparticle walls [15]. Due to stabilizing action of surfactants, it is possible to obtain nanoparticles with the (100) facets, which are hard to obtain by other methods due to their thermodynamic instability. However, use of chemical or electrochemical methods of purification leads to destruction of such crystallographic domains Thus, use of surfactants limits, to the large extent, the possibility of employing nanoparticles with the (100) facets in catalysis.

An alternative for chemical reduction in the presence of a surfactant and purification of such obtained nanoparticles, are the methods which do not employ a surfactant. Such methods include, for example, cathodic corrosion or sputtering, however efficiency of such methods is too low to find a practical use. Lately it was shown that pure silver nanoparticles could be obtained by the laser ablation of a metal immersed in water [16]. Due to agglomeration of the formed particles, the method allows to obtain only colloids of nanoparticles at a low concentration. In addition, the method involves very expensive infrastructure, which additionally limits its use.

The present inventors have also undertaken attempts to synthesize nanostructures without use of surfactants. WO 2013/186740 discloses a process for synthesis of nanostructures in a flow system, in which a precursor substance solution undergoes reduction reaction using a reducing agent solution and nanoparticles are produced, wherein the reduction reaction is terminated by adding an agent neutralizing the reducing agent. The publication by Januszewska et al. [17] discloses a process for the platinum nanoparticle synthesis by reduction of platinum salts or complexes in situ with ethylene glycol. Results of the studies presented therein indicate that the method led to obtaining ultra-pure platinum nanoparticles characterized by relatively high surface organization, which was illustrated by presence of the (111) and (100) facets.

However, the methods known from the prior art are still unsatisfactory. There is a need to develop an environment-friendly, simple method for the preparation of nanoparticles of high surface purity and a controlled size, wherein surfactants are not employed, and consequently the purification procedure is eliminated. It would be also desirable for the method to result in obtaining pure nanoparticles with the well-organized surface (e.g. characterized by the (100) facets), that would significantly increase their catalytic properties.

The invention provides a method of preparing pure precious metal nanoparticles of a controlled size and having the (100) facets, wherein a precursor substance contained in a reagent solution is subjected to a reduction reaction using a reducing agent contained in the reagent solution to form nanoparticles, said reduction reaction being conducted in the absence of a surfactant and terminated after the predetermined time t, preferably in the range of 14 seconds to 2 hours, by rapidly lowering the temperature of the reaction mixture. A reagent solution means a solution where the reduction reaction is conducted and it comprises a precursor substance and a reducing agent, and the synthesized nanoparticles appear therein in the course of the reduction reaction. By a reaction solution, the solution is meant where the synthesized nanoparticles and optional unreacted reagents are present (i.e. the precursor substance and/or the reducing agent).

Not wishing to be bound by any theory, the present inventors noticed that a cooling rate of the reaction solution could be critical for increasing the number of nanoparticles with the (100) facets. Thus, according to the invention, lowering of the reaction solution temperature is carried out at a rate higher than or equal to 0.15° C./s. Such conditions are, for example, fulfilled when the reaction solution (e.g. present in a tube or a loop formed therefrom a mixture of a solvent, nanoparticles and optionally unreacted reagents) is placed in a bath at 0° C. (e.g. a water-ice mixture), or when the reaction mixture present in the flow system is pumped over to the cooling zone of the flow system, wherein a tube or a loop formed therefrom is immersed in the above-indicated bath.

In a further preferred embodiment of the method according to the invention, the reduction reaction follows a rapid increase of the temperature of the reagent solution prepared in advance at a room or lower temperature (i.e. "in the cold state"). For example, the reagent solution prepared in advance is charged at a room or lower temperature into the reaction system or the reaction zone of the flow system (e.g. to a tube or a loop formed therefrom immersed in a bath, at a temperature suitable for conducting the reduction reaction), thus resulting in increase of its temperature.

Again, not wishing to be bound by any theory, the rate the reagent solution is heated with seems also to be a key parameter for a number of the (100) facets obtained. Thus, according to the invention, increasing the temperature of the reagent solution is carried out at a rate higher than or equal to 0.15° C./s.

Preferably the time t, after which the reduction reaction is stopped, is equal to 1 min., 2 min., 5 min., 15 min., 30 min. or 1 h. It should be appreciated that the time after which the reaction of the precursor substance reduction is stopped, includes also the step of heating the reagent solution.

In a preferred embodiment, the method of the invention is carried out in a flow system, comprising interconnected tubes or loops formed therefrom, through which the reagent solution and reaction solution flows, said tubes or loops being located in a reaction and cooling zones of the flow system, and tube or loop lengths in the reaction zone wherein the reagent solution is charged, as well as a flow rate of the solution are selected to provide a suitable time t of the reduction reaction, with the cooling zone ensuring rapid cooling of the reaction solution that flows through a tube or loop located therein.

In a system like that, a method of synthesis with a stopped flow (a stopped-flow type method) could also be employed. It means that, after the reagent solution is introduced into a tube or a loop formed therefrom located in the reaction zone, the flow of the solution is stopped. The temperature of the solution increases rapidly and the reduction process leading to formation of nanoparticles takes place. After the predetermined time t, the reduction reaction is stopped by resuming the flow and passing the reaction solution into the tube or loop formed therefrom, located in a cooling zone of the system, where rapid cooling of the reaction solution takes place.

In an alternative embodiment of the method according to the invention the reduction reaction is conducted by charging the reagent solution into a tube or a loop formed therefrom located in the reaction system, and after a predetermined time t said tube or loop containing the reaction solution is transferred to a cooling system, where rapid lowering of the reaction solution temperature takes place.

In a preferred embodiment of the method according to the invention the reaction solution contained in the tube or loop formed therefrom, during the cooling step (i.e. when located in a cooling system or a cooling zone of the flow system), is subjected to ultrasonication. This prevents adhering of nanoparticles to tube walls and is particularly important in the case where the tube employed is a Teflon tube and/or in the case where neither the reduction reaction, nor the cooling is carried out with the simultaneous flow of the solutions. In the case of employing tubes made of other materials, use of the ultrasounds may not be necessary. The ultrasound treatment can be carried out by placing the cooling system in an ultrasonication bath.

The reaction zone or reaction system allows to control the temperature, in which the reduction of the precursor substance takes place. Preferably, the reaction zone or reaction system comprises a bath (e.g. a bath with ethylene glycol, provided with a heating means) and a temperature controller. This allows to maintain the temperature at which the reduction reaction is carried out. Preferably, the reduction reaction is carried out at the temperature of from 70° C. to 190° C., more preferably at about 82° C., 95° C., 109° C., 120° C., 130° C., 140° C., 147° C. or 150° C. The term reaction zone or reaction system, as defined herein, refers to both the element providing the suitable temperature (e.g. a bath with a temperature controller), and to such an element, in which a tube or loop formed therefrom is accommodated, wherein the reagent solution is introduced into and/or passed through.

The cooling zone or cooling system allows to rapidly lower the reaction solution temperature, to stop the conducted reduction reaction. Most preferably, the reaction solution temperature is lowered after the time t by immersion in a water bath at the temperature of 0° C. Thus, the cooling zone or cooling system comprises a bath at suitably low temperature (e.g. a water-ice bath at 0° C.). The term cooling zone or cooling system, as defined herein, refers to both the element providing the suitable cooling temperature, and such an element in which a tube or loop formed therefrom is accommodated, wherein the reaction solution is present into and/or passed through.

According to the present invention the reduction reaction, as well as cooling of the reaction solution, is conducted in a loop made from Teflon tube of 25 cm in length, having the outer diameter of ⅛" and the inner diameter of 1/16". Preferably, the diameter of the loop is 6 cm. The length of the tube is of importance only in the case of a flow synthesis method, since it determines the duration of the reduction reaction, and consequently influences the quantity of nanoparticles obtained and their sizes. Other synthesis system parameters, e.g. a cross-section of the tube, influence the cooling and heating rate of the solution contained therein.

The further preferred step of the method according to the invention comprises separating the nanoparticles from the reaction solution by centrifuging. The separated nanoparticles are preferably rinsed (e.g. with distilled water) and re-centrifuged. Preferably, the step of rinsing with distilled water and centrifugation is carried out three times.

Preferably, in the method of the invention a precursor of a precious metal or a mixture of precursors of precious metals are employed as a precursor substance. More preferably, the metal precursor comprises a salt or complex thereof or a mixture of salts or complexes of various metals.

Most preferably, a metal is selected from the group comprising platinum, palladium, silver, gold, ruthenium, osmium, iridium and rhodium. In a preferred embodiment, the precursor substance comprises a salt selected from the group comprising $AgNO_3$, $AgClO_4$, $AgHSO_4$, $Ag_2SO_4$, AgF, $AgBF_4$, $AgPF_6$, $CH_3COOAg$, $AgCF_3SO_3$, $H_2PtCl_6$, $H_6Cl_2N_2Pt$, $PtCl_2$, $PtBr_2$, $K_2PtCl_4$, $Na_2[PtCl_4]$, $Li_2[PtCl_4]$, $H_2Pt(OH)_6$, $Pt(NO_3)_2$, $[Pt(NH_3)_4]Cl_2$, $[Pt(NH_3)_4](HCO_3)_2$, $[Pt(NH_3)_4](OAc)_2$, $(NH_4)_2PtBr_6$, $K_2PtCl_6$, $PtSO_4$, $Pt(HSO_4)_2$, $Pt(ClO_4)_2$, $H_2PdCl_6$, $H_6Cl_2N_2Pd$, $PdCl_2$, $PdBr_2$, $K_2[PdCl_4]$, $Na_2[PdCl_4]$, $Li_2[PdCl_4]$, $H_2Pd(OH)_6$, $Pd(NO_3)_2$, $[Pd(NH_3)_4]Cl_2$, $[Pd(NH_3)_4](HCO_3)_2$, $[Pd(NH_3)_4](OAc)_2$, $(NH_4)_2PdBr_6$, $(NH_3)_2PdCl_6$, $PdSO_4$, $Pd(HSO_4)_2$, $Pd(ClO_4)_2$, $HAuCl_4$, $AuCl_3$, AuCl, $AuF_3$, $(CH_3)_2SAuCl$, AuF, $AuCl(SC_4H_8)$, AuBr, $AuBr_3$, $Na_3Au(S_2O_3)_2$, $HAuBr_4$, $K[Au(CN)_2]$, $RuCl_2((CH3)_2SO)_4$, $RuCl_3$, $[Ru(NH_3)_5(N_2)]Cl_2$, $Ru(NO_3)_3$, $RuBr_3$, $RuF_3$, $Ru(ClO_4)_3$, OsI, $OsI_2$, $OsBr_3$ , $OsCl_4$, $OsF_5$, $OsF_6$, $OsOF_5$, $OsF_7$, $IrF_6$, $IrCl_3$, $IrF_4$, $IrF_5$, $Ir(ClO_4)_3$, $K_3[IrCl_6]$, $K_2[IrCl_6]$, $Na_3[IrCl_6]$, $Na_2[IrCl_6]$, $Li_3[IrCl_6]$, $Li_2[IrCl_6]$, $[Ir(NH_3)_4Cl_2]Cl$, $RhF_3$, $RhF_4$, $RhCl_3$, $[Rh(NH_3)_5Cl]Cl_2$, $RhCl[P(C_6H_5)_3]_3$, $K[Rh(CO)_2Cl_2]$, $Na[Rh(CO)_2Cl_2]$ $Li[Rh(CO)_2CL_2]$, $Rh_2(SO_4)_3$, $Rh(HSO_4)_3$ and $Rh(ClO_4)_3$, hydrates thereof or a mixture of salts and/or hydrates thereof. Most preferably, the precursor substance is $K_2PtCl_4$. The initial concentration of a precursor substance in the reagent solution is preferably from 1 mM to 1 M, more preferably from 50 mM to 100 mM, and most preferably about 70 mM. Using the saturated solution of the precursor substance is possible.

Preferably, the precursor substance is also a source of halides and/or pseudohalides, and chlorides in particular. The precursor substance could directly provide the reagent solution with halides and/or pseudohalides, or it could constitute a source of halides and/or pseudohalides which appear in the reaction mixture as a result of the running reaction.

The reducing agent that can be preferably employed in the process of the invention is selected from the group comprising ethylene glycol, hydrazine, ascorbic acid, sodium borohydride, sodium hypophosphite, lithium tetraethyloborohydride, methyl alcohol, 1,2-hexadecanediol, hydroxylamine and dimethylborazane DMAB. Most preferably, ethylene glycol is used as a reducing agent. The initial concentration of the reducing agent in the reagent solution is from 0.5 mM to 4 M.

In a particularly preferred embodiment of the method according to the invention the reagent solution comprises a solution of the precursor substance in ethylene glycol, with the precursor substance, preferably $K_2PtCl_4$, being dissolved in ethylene glycol at the ambient temperature (i.e. "in the cold state"), and ethylene glycol plays simultaneously a role of the solvent, as well as the reducing agent.

In a preferred embodiment of the method of the invention, the reagent solution contains halides and/or pseudohalides at a relatively high concentration. The halides and/or pseudohalides are present preferably in the reaction solution at a concentration higher than 20 mM, preferably higher than 40 mM, more preferably higher than 250 mM, and most preferably 280 mM. Alternatively, the reagent solution is the saturated solution of halide and/or pseudohalide salts. In a particularly preferred embodiment, the concentration of halides in the reaction solution increases as a result of reduction (decomposition) of the precursor substance and release of the constituent halides. For example, when the precursor substance is $K_2PtCl_4$, the concentration of chlorides in the reaction solution increases in the reduction process.

The halides employed in the method of the invention are preferably selected from the group comprising fluorides, chlorides, bromides and iodides, the pseudohalides are selected from the group comprising cyanides, cyanates, isocyanates and thiocyanates. Most preferably the halides and/or pseudohalides are introduced into the reagent solution in a form of lithium, potassium or calcium salts. Furthermore, halides and/or pseudohalides can be introduced into the reaction solution directly in a form of the precursor substance, e.g. $PtCl_2$ or $K_2PtCl_4$.

Not wishing to be bound by any theory, the present inventors found that high concentration of halides and/or pseudohalides could exert stabilizing effect on the (100) facets of the formed nanoparticles. In the reference example, wherein conditions of synthesis as disclosed in the publication by Januszewska et al. [17] were reproduced, the initial concentration of $K_2PtCl_4$ was about 4.5 mM, while in the method of the invention the concentration of $K_2PtCl_4$ was about 72 mM. Thus, in the method of the invention, the concentration of chlorides appearing during the course of synthesis was markedly higher. Consequently, the chloride ions, which appear in the reaction mixture could influence beneficially the crystalline structure of the nascent nanoparticle surfaces.

Thus the present inventors developed an effective method of preparing of the precious metal nanoparticles, by reducing compounds of precious metals in the flow system, both by the flow method, and the stopped-flow method. A mixture of the reducing agent and the precursor is fed to the flow system. The reaction duration is controlled by the flow rate and/or the time of the solution is present in the system after the flow is stopped, and sizes of the obtained nanoparticles depend on parameters of the process, such as the duration and temperature of the reaction. In the event of employing the stopped-flow method, the amount of the nanoparticles obtained depends also on lengths of the tubes wherein the reaction is carried out. A characteristic feature of such a technical solution is a precise control of the reaction duration and a very high heating and cooling rate of the reaction mixture in the flow system and in the stopped-flow system. The high heating rate and stabilization of the end temperature allows to control the nucleation process, as well as further reduction, which makes it possible to control the size of the formed nanoparticles without addition of a surfactant. The synthesis conditions employed in the technical solution of the invention allow to freeze non-equilibrium states (obtaining nanoparticles with metallic glass character, alloys of non-segregated metals which segregate in normal conditions etc.). By controlling the reaction duration and the temperature, the control over size, shape of nanoparticles and crystalline properties of their surfaces was gained.

The invention provides also nanoparticles of precious metals, prepared with the method of the invention, and use of such particles as heterogenous catalysts. The nanoparticles according to the invention are characterized by high purity (their purification is not necessary, since in the method of their preparation no surfactants are employed) and a particularly significant number of the (100) facets (as it is clear from the examples that follow, a number of that kind of facets is at average twice as large as in the case of the synthesis process disclosed in the publication by Januszewska, A. et al. [17]). Thus the nanoparticles prepared by the method of the invention, after they are isolated from the reaction solution and rinsed, could be directly employed in heterogeneous catalysis. The fact that the chemical or electrochemical purification is not necessary renders the nanoparticles prepared by the method of the invention suitable for use as catalysts. Moreover, the greater number of the (100) facets likewise enhances their catalytic properties.

Methods for the preparation nanoparticles in the flow-through systems are known in the art. However, the size is controlled principally by changing physicochemical properties of the reaction mixture, such as a pH value or a composition. The publication by Baumgard J. et al. discloses a process for reduction of a platinum salt with ethylene glycol in a flow system, with the use of NaOH to control the pH level and PVP to stabilize the size, to yield nanoparticles of the sizes of 1 do 4 nm, depending on conditions of synthesis employed [18]. It was demonstrated in particular how the temperature, pH and flow rate control sizes of obtained nanoparticles. Two kinds of flow systems were employed: in the first one, nanoparticles were prepared in an one-step process, in the second one, steps of nucleation and nanoparticle growth were divided into two independent steps. Regardless of the system used, the addition of surfactant (PVP) was employed.

Another research work employed the flow system, wherein a mixture of a precursor and a reducing agent were heated with microwaves. Again, in this case a mixture of starting materials contained a surfactant (the same PVP). No relationship between sizes of formed nanoparticles and a temperature of the process was demonstrated (the synthesis was conducted at the constant temperature, i.e. 160° C.) and solely for the two reaction times (2.8 and 28.3 s) [19].

Preparation of nanoparticles of controlled shapes was described by Feliu et al. [15], however, surfactants were employed to this end.

The method of preparing of nanoparticles disclosed in the present application does not involve surfactants, and the control of shape is obtained by controlling conditions of the synthesis. The requirement of chemical or electrochemical purification of the nanoparticles obtained was eliminated thereby. Another advantage of the method according to the invention is the increased presence of the (100) facets in the nanoparticles obtained, which enhances to a significant degree their catalytic properties.

The invention is illustrated by the drawing, wherein.

EXAMPLES

Example 1

Figure 1:
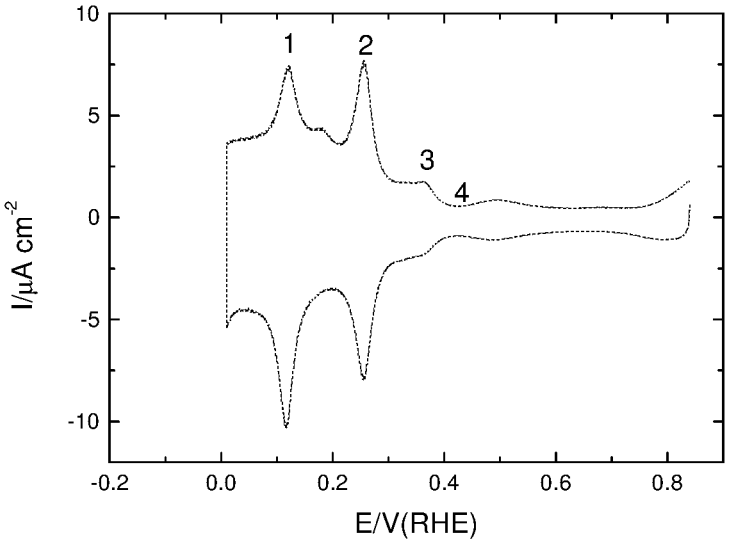
FIG. 1 shows an example of a voltammogram recorded for Pt nanoparticles prepared by the method according to the invention.

A Method of Preparing of Pt Nanoparticles

Reaction Systems

A synthesis of nanoparticles employs loops made from Teflon tubes 25 cm in length with an inner diameter of ⅛" and outer diameter of 1/16". A diameter of the loop is about 6 cm, and a volume thereof—about 1.8 $cm^3$.

The synthesis by a flow method or a stopped-flow method employs a system comprising two connected loops: the reaction and cooling loops. The reaction loop is accommodated in an ethylene glycol bath and heated to a reaction temperature. The temperature of the ethylene glycol bath is controlled by a temperature controller, and additionally, to provide an equal temperature in the entire bath, the content thereof is stirred with a magnetic stirrer. The cooling loop is located in an ultrasonication bath with water at 0° C. The reagent solution is forced to the reaction loop by means of a peristaltic pump and pumped as the reaction solution into the cooling loop, where it is subjected to ultra-sonication. The flow can be stopped to extend the reduction and/or cooling time.

Alternatively, a sole loop, which is initially introduced into the above-mentioned ethylene glycol bath heated to the reaction temperature, and into which the reagent solution is forced by means of a peristaltic pump, is employed. Then, after the reaction is completed, the loop is transferred to the ultrasonication bath with water at 0° C. to rapidly cool the reaction solution.

In the experiments, the flow rate in the loop(s) is 0.12 $cm^3 s^{-1}$ (1.7 cm $s^{-1}$).

Reagent Solution

For a synthesis of platinum nanoparticles, the solution of $K_2PtCl_4$ (99.9%—Alfa Aesar) in ethylene glycol (EG) (99.5%—Fluka) is employed. For one volume of the loop, 50 mg of the above-indicated platinum salt (corresponding to a concentration of about 30 mg/$cm^3$ (~72 mM)) is used. The platinum salt solution is prepared "in the cold state" (i.e. at the room temperature).

The Pt salt concentration in EG is thus much higher than in the prior art [17].

Synthesis of Nanoparticles in a Flow System

The platinum salt solution in EG (the reagent solution) at the room temperature is forced by means of a peristaltic pump to the reaction loop maintained at the reaction temperature, and flows to the cooling loop for rapid cooling of the reaction solution (the flow rate is 12 $cm^3 s^{-1}$). After the reaction solution is pumped into the cooling loop, the flow is stopped for about 5 min. In the course of cooling, the reaction solution present in the cooling loop is subjected to ultrasonication. After cooling, the loop content is pumped over to the test tube as a sample receiver.

The synthesis of nanoparticles in the flow system is conducted by maintaining the reaction loop at various temperatures. The results shown correspond to the reduction reactions carried out at 82° C., 95° C., 109° C. and 147° C. No nanoparticles were obtained at the flow rate of 12 $cm^3 s^{-1}$ at 82° C. and 95° C. The Pt nanoparticles produced by the flow system at 109° C. and 147° C. were investigated further.

Synthesis of Nanoparticles by the Stopped-flow Method

The platinum salt solution in EG (the reagent solution) at the room temperature is forced by means of a peristaltic pump to the reaction loop maintained at the reaction temperature. After the entire portion of the solution is introduced into the reaction loop, the flow is stopped for a predetermined time t. After the reaction time expiry, the rapid cooling of the reaction solution was effected by pumping the solution from the reaction loop to the cooling loop or by transferring the reaction loop into the cooling system (a water bath at 0° C.). On cooling, the solution is subjected to ultrasonication. After cooling for about 5 min. the loop content is pumped over to the test tube as a sample receiver.

The synthesis of nanoparticles in a stopped-flow system is conducted by maintaining the reaction loop at various temperatures. The results shown correspond to the reduction reactions carried out at 82° C., 95° C., 109° C., 120° C., 130° C., 140° C., 147° C. and 150° C. for 1 min., 2 min., 5 min., 15 min., 30 min. and 1 h.

At 82° C. no nanoparticles were obtained during the synthesis carried out for 15 min., 5 min., 2 min. and 1 min. No nanoparticles were obtained at 95° C. during the synthesis conducted for 2 min. and 1 min. The Pt nanoparticles produced by this method were investigated further.

Separation of Nanoparticles

Centrifuging is employed to separate the nanoparticles from the post-reaction mixture. After centrifuging, the reaction solution supernatant is discarded, and the nanoparticles are rinsed three times with distilled water and separated again by centrifuging.

Example 2

Properties of the Pt Nanoparticles Investigated by the Electrochemical Method Electrochemical Measurements To investigate properties of the Pt nanoparticles by the electrochemical method, the suspension of the Pt nanoparticles obtained in Example 1, is applied with an automatic measuring pipette onto an Au substrate and left to air-dry. The testing array is composed of a mercury-sulfate reference electrode ($Hg/Hg_2SO_4/0.1M\ H_2SO_4$), a gold auxiliary electrode and the nanoparticles deposited on a gold substrate, as a working electrode. The study is conducted in 0.5 M sulfuric (VI) acid as a primary electrolyte. All electrodes are placed in a beaker. The system is sealed by a well-fitting Teflon lid, and then deoxygenated by purging with argon for 35 minutes.

The gold electrode and the beaker with the Teflon lid are cleaned in the Caro acid before use.

All voltammograms are recorded at a rate of 5 mV/s. To standardize the data, a charge to reduce the oxide layer is determined for each electrode at the range of potentials from 0.5-1.1V.

Results and Discussion

FIG. 1 shows an exemplary voltammogram recorded for the Pt nanoparticles obtained in Example 1. Peaks marked on the voltammogram are the peaks characteristic for all the obtained nanoparticles. Peaks 1, 2 and 3 are connected with adsorption of hydrogen at the Pt surface. Peak 3 is a characteristic peak for adsorption at the (100) facets, peak 2 includes the contribution of adsorption at the (100) facets. The current marked as 4 is connected generally with charging of the double layer. Since that value should be independent of the kind of walls at the nanoparticle surfaces, it was used as an additional standardizing value to determine changes in peak heights after deducting that value, as a baseline value, from the current value for the peak.

The appearance of the voltammogram confirms the fact that nanoparticles obtained in Example 1 are characterized by the high surface purity and the presence of a significant number of the (100) facets.

Analysis of values of the signals connected with hydrogen adsorption at the (100) facets and comparing them with analogous data for nanoparticles obtained by the method as described in the publication by Januszewska A. et al. [17], revealed that the number of the (100) facets in nanoparticles obtained by the method of the invention is more than two times higher.

Figure 2:
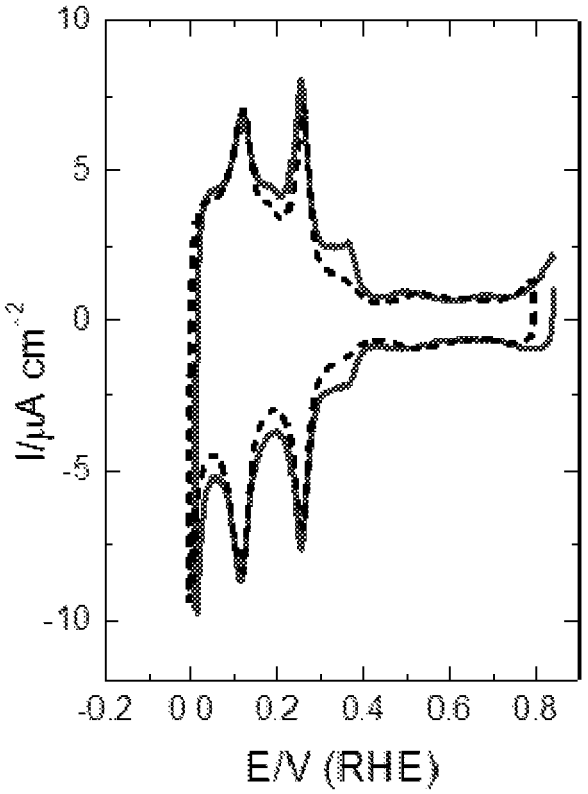
FIG. 2 illustrates a comparison of a voltammogram recorded for the Pt nanoparticles prepared by the method according to the invention (in the reduction reaction conducted for 1 h at 150° C.) and Pt nanoparticles obtained in a reference example by the method disclosed in the publication by Januszewska A. et al. [17]

FIG. 2 shows a comparison of a voltammogram recorded for the Pt nanoparticles obtained in Example 1 by the reduction reaction conducted for 1 h at a temperature 150° C., and the Pt nanoparticles obtained by the method as described in the publication by Januszewska A. et al. [17].

The analysis of signals connected with hydrogen adsorption at the (100) facets for nanoparticles obtained at various temperatures revealed that the number of the (100) facets does not depend on a temperature the reduction reaction is conducted at (ratios of characteristic signal heights to reference signal heights are practically constant).

Figure 3:
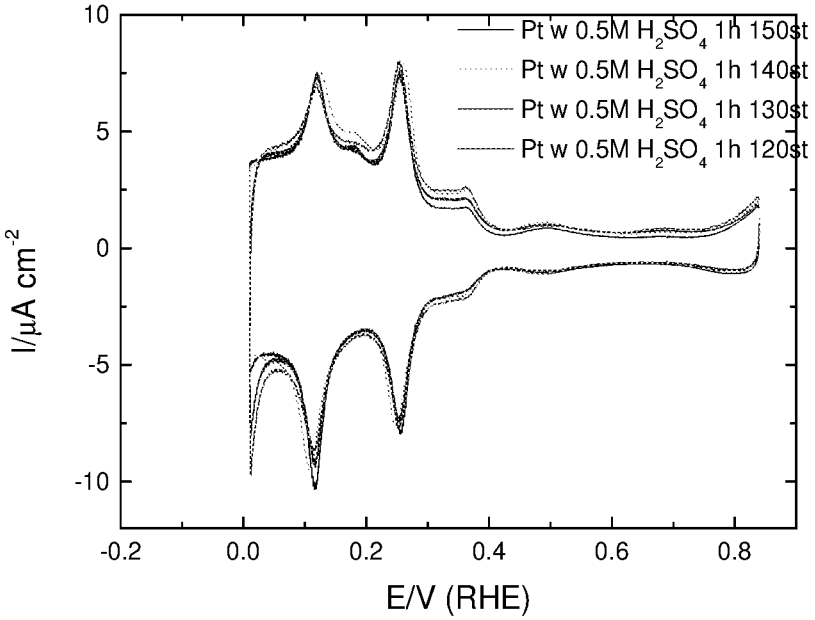
FIG. 3 shows voltammograms recorded for the Pt nanoparticles prepared by the reduction reaction conducted for 1 h at 120° C., 130° C., 140° C. and 150° C.

FIG. 3 shows voltammograms recorded for the Pt nanoparticles obtained by the reduction reaction carried out for 1 h at 120° C., 130° C., 140° C. and 150° C. Table 1 shows a list of the peak values for voltammograms presented on FIG. 3 and compares them with the literature data [17]. Numbers represent values of current intensities in μA per $cm^2$ of Pt nanoparticle surfaces. To calculate relative values of the current intensities (the two rightmost table columns), the values of current intensities for peaks 1, 2 and 3 were corrected by a value of the capacitive current, the value of which had been subtracted from the values of peak 1, 2 and 3 currents before relative values were calculated. The value calculated in the rightmost column is of a particularly significant analytical value, since it is directly connected with a number of the (100) facets present in a sample.

TABLE 1

List of values of current intensities for the peaks and values of the capacitive current recorded by the voltammetric method for the Pt nanoparticles obtained in 1 h at various temperatures

| Pt nanoparticle synthesis temp. [° C.] | Current intensity value for peak 1 [μA/$cm^2$] | Current intensity value for peak 2 [μA/$cm^2$] | Current intensity value for peak 3 [μA/$cm^2$] | Capacitive current intensity value (4) [μA/$cm^2$] | Current intensity value for peak 2 to current intensity value for peak 1 ratio | Current intensity value for peak 3 to current intensity value for peak 4 ratio |
|---|---|---|---|---|---|---|
| 120 | 6.94 | 7.958 | 2.617 | 0.794 | 1.17 | 2.30 |
| 130 | 7.417 | 7.546 | 2.141 | 0.761 | 1.02 | 1.81 |
| 140 | 7.564 | 7.927 | 2.539 | 0.799 | 1.05 | 2.18 |
| 150 | 7.442 | 7.707 | 1.806 | 0.543 | 1.04 | 2.33 |

TABLE 1-continued

List of values of current intensities for the peaks and values of the capacitive current recorded by the voltammetric method for the Pt nanoparticles obtained in 1 h at various temperatures

| Pt nanoparticle synthesis temp. [° C.] | Current intensity value for peak 1 [μA/cm$^2$] | Current intensity value for peak 2 [μA/cm$^2$] | Current intensity value for peak 3 [μA/cm$^2$] | Capacitive current intensity value (4) [μA/cm$^2$] | Current intensity value for peak 2 to current intensity value for peak 1 ratio | Current intensity value for peak 3 to current intensity value for peak 4 ratio |
|---|---|---|---|---|---|---|
| Literature data [17] | 7.092 | 7.189 | 1.2587 | 0.62478 | 1.01 | 1.01 |

Example 3

TEM Imaging of the Pt Nanoparticles and Determining Their Sizes

Figure 4:
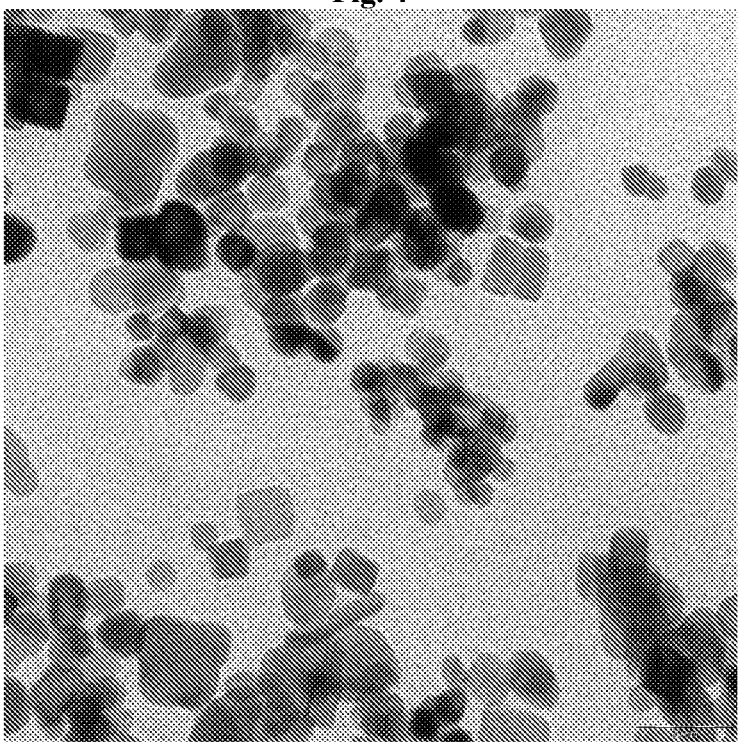
FIG. 4 shows a TEM micrograph of Pt nanoparticles prepared by the reduction reaction conducted for 1 h at 147° C.

The nanoparticles obtained in Example 1 were imaged by TEM. FIG. 4 represents an illustrative TEM micrograph of the Pt nanoparticles obtained by the reduction reaction conducted for 1 h at 147° C. The shape of the nanoparticles confirms further the presence of the (100) facets. The shape of the nanoparticles is determined by dominating crystallographic walls. On the TEM micrographs, the nanoparticles of characteristic cube shapes are visible.

The TEM micrographs were used for determining an average nanoparticle size by employing the Measure IT software pack. Table 2 lists average particle size (diameter) versus a reduction time and temperature.

TABLE 2

List of Pt nanoparticle sizes (nm) depending on the time and temperature of conducting the reduction reaction

| Reduction time | Reduction temperature | | | |
|---|---|---|---|---|
| | 82° C. | 95° C. | 109° C. | 147° C. |
| Reaction in a flow system | — | — | 5.32357 | 8.15619 |
| 1 min | — | — | 5.512 | 8.34095 |
| 2 min | — | — | 5.1105 | 7.86286 |
| 5 min | — | 3.51833 | BD | 8.39561 |
| 15 min | — | 3.51527 | 5.35737 | 8.55111 |
| 30 min | 5.30565 | 3.78313 | 6.3995 | 8.963 |
| 1 h | 3.89589 | 4.4196 | 9.36355 | 10.98344 |

— means that no nanoparticles were obtained
BD means no data

Sizes of various numbers of nanoparticles were measured in various instances. Nanoparticles obtained at low temperatures and short reduction times agglomerate, making impractical the measurement of sizes for more than 20 nanoparticles.

Sizes of the obtained nanoparticles depend on the duration t of the reaction and the reaction temperature. The reaction duration depends on a flow rate of the reagent solution (the Pt salt solution in EG) within the reaction loop or time when the reagent solution is present within the reaction loop following the stopping of the flow.

Reference Example

Preparation of Nanoparticles by the Method Described in the Publication by Januszewska et al. [17]

To 110 ml of ethylene glycol (Fluka) in a round-bottomed flask, 0.0005 mol $K_2PtCl_4$ (99.9%—Alfa Aesar) (0.2083 g) was added to provide a solution of $K_2PtCl_4$ with the concentration of about 4.56 mM.

The reduction reaction was conducted by heating the flask under reflux with concomitant agitation (using magnetic stirrer).

The flask content was heated starting at the room temperature at the rate of about 5° C. per minute till 112° C. The reaction took place for about 5 minutes. In the course of the reaction the temperature increased to 123.7° C., and dropped to 119.6° C. during last 2 minutes of the reaction.

The concentration of chlorides in the post-reaction solution was about 18.25 mM.

After the reaction was completed, the flask was left to cool at the room temperature. Nanoparticles were isolated from glycol by centrifuging and rinsing (as described in Example 1).

FIG. 2 shows a voltammogram of the nanoparticles obtained by this method.

REFERENCES

1. Ahmadi, T. S.; Wang, Z. L.; Green, T. C.; Henglein, A.; ElSayed, M. A., Shape-controlled synthesis of colloidal platinum nanoparticles. *Science* 1996, 272, (5270), 1924-1926.
2. Yamada, M.; Kon, S.; Miyake, M., Synthesis and size control of Pt nanocubes with high selectivity using the additive effect of NaI. *Chem. Lett.* 2005, 34, (7), 1050-1051.
3. Chen, J. Y.; Herricks, T.; Geissler, M.; Xia, Y. N., Single-crystal nanowires of platinum can be synthesized by controlling the reaction rate of a polyol process. *J. Am. Chem. Soc.* 2004, 126, (35), 10854-10855.
4. Chen, J. Y.; Herricks, T.; Xia, Y. N., Polyol synthesis of platinum nanostructures: Control of morphology through the manipulation of reduction kinetics. *Angew. Chem. Int. Ed.* 2005, 44, (17), 2589-2592.
5. Herricks, T.; Chen, J. Y.; Xia, Y. N., Polyol synthesis of platinum nanoparticles: Control of morphology with sodium nitrate. *Nano Letters* 2004, 4, (12), 2367-2371.
6. Song, H.; Kim, F.; Connor, S.; Somorjai, G. A.; Yang, P. D., Pt nanocrystals: Shape control and Langmuir-Blodgett monolayer formation. *J. Phys. Chem. B* 2005, 109, (1), 188-193.
7. Solla-Gullon, J.; Montiel, V.; Aldaz, A.; Clavilier, J., Synthesis and electrochemical decontamination of platinum-palladium nanoparticles prepared by water-in-oil microemulsion. *J. Electrochem. Soc.* 2003, 150, (2), E104-E109.
8. Solla-Gullon, J.; Rodes, A.; Montiel, V.; Aldaz, A.; Clavilier, J., Electrochemical characterisation of platinum-palladium nanoparticles prepared in a water-in-oil microemulsion. *J. Electroanal. Chem.* 2003, 554, 273-284.

9. Niesz, K.; Grass, M.; Somorjai, G. A., Precise control of the Pt nanoparticle size by seeded growth using EO13PO30EO13 triblock copolymers as protective agents. *Nano Letters* 2005, 5, (11), 2238-2240.
10. Solla-Gullon, J.; Montiel, V.; Aldaz, A.; Clavilier, J., Electrochemical characterisation of platinum nanoparticles prepared by microemulsion: how to clean them without loss of crystalline surface structure. *J. Electroanal. Chem.* 2000, 491, (1-2), 69-77.
11. Solla-Gullon, J.; Montiel, V.; Aldaz, A.; Clavilier, J., Electrochemical and electrocatalytic behaviour of platinum-palladium nanoparticle alloys. *Electrochem. Comm.* 2002, 4, (9), 716-721.
12. Conway, B. E.; Angerstein-Kozlowska, H.; Sharp, W. B. A.; Criddle, E. E., Ultrapurification of Water for Electrochemical and Surface Chemical Work by Catalytic Pyrodistillation. *Anal. Chem.* 1973, 45, (8), 1331-1336.
13. Monzo, J.; Koper, M. T. M.; Rodriguez, P., Removing Polyvinylpyrrolidone from Catalytic Pt Nanoparticles without Modification of Superficial Order. *Chemphyschem* 2012, 13, (3), 709-715.
14. Kuhn, J. N.; Tsung, C.-K.; Huang, W.; Somorjai, G. A., Effect of organic capping layers over monodisperse platinum nanoparticles upon activity for ethylene hydrogenation and carbon monoxide oxidation. *Journal of Catalysis* 2009, 265, (2), 209-215.
15. Beyerlein, K. R.; Solla-Gullon, J.; Herrero, E.; Gamier, E.; Pailloux, F.; Leoni, M.; Scardi, P.; Snyder, R. L.; Aldaz, A.; Feliu, J. M., Characterization of (111) surface tailored Pt nanoparticles by electrochemistry and X-ray powder diffraction. *Materials Science and Engineering a-Structural Materials Properties Microstructure and Processing* 2010, 528, (1), 83-90.
16. Pyatenko, A.; Shimokawa, K.; Yamaguchi, M.; Nishimura, O.; Suzuki, M., Synthesis of silver nanoparticles by laser ablation in pure water. *Applied Physics a-Materials Science & Processing* 2004, 79, (4-6), 803-806.
17. Januszewska, A.; Dercz, G.; Piwowar J.; Jurczakowski R.; Lewera A., Outstanding catalytic activity of ultra-pure platinum nanoparticles. *Chem. Europ. J.,* 2013, 19, (50), 17159-17164.
18. Baumgard, J.; Vogt, A. M.; Kragl, U.; Jahnisch, K.; Steinfeldt, N., Application of microstructured devices for continuous synthesis of tailored platinum nanoparticles. *Chem Eng J* 2013, 227, 137-144.
19. Nishioka, M.; Miyakawa, M.; Daino, Y.; Kataoka, H.; Koda, H.; Sato, K.; Suzuki, T. M., Rapid and Continuous Polyol Process for Platinum Nanoparticle Synthesis Using a Single-mode Microwave Flow Reactor. *Chem. Lett.* 2011, 40, (12), 1327-1329.

The invention claimed is:

1. A method of preparing of pure precious metal nanoparticles of controlled sizes and having (100) facets, wherein a precursor substance comprising a precious metal salt or precious metal complex, or a mixture salts and/or complexes of various precious metals, which is contained in a reagent solution is subjected to a reduction reaction by a reducing agent contained in the reagent solution to provide nanoparticles in a resulting reaction solution, wherein the reduction reaction is conducted in a reaction zone in absence of a surfactant and with the initial concentration of the precursor substance in the reagent solution from 50 mM to 100 mM, and the reduction reaction is stopped after a pre-determined time t from 14 seconds to 2 hours by rapid lowering of the reaction solution temperature in a cooling zone at a rate higher than or equal to 0.15° C./s.

2. The method of claim 1, wherein the reduction reaction is preceded by a rapid increase of the reagent solution temperature at a rate higher than or equal to 0.15° C./s, wherein the reagent solution is prepared in advance at the room or lower temperature.

3. The method of claim 1, wherein the reaction is conducted in a flow system comprising reaction and cooling zones and interconnected loops, through which the reagent solution and reaction solution flows, wherein said loops are placed respectively in the reaction and cooling zone of the flow system, and a length of the loop in the reaction zone, where the reagent solution is introduced, and a solution flow rate are selected to provide a pre-determined reduction reaction time t, while the cooling zone provides rapid cooling of the reaction solution flowing through the loop contained therein.

4. The method of claim 3, wherein the reduction reaction is conducted by charging the reagent solution into the loop located in the reaction zone, and after a pre-determined time t the loop, which contains the reaction solution, is transferred to the cooling zone, where rapid lowering of the reaction solution temperature takes place and the reaction solution is subjected to ultrasonication.

5. The method of claim 1, wherein the obtained nanoparticles are separated from the reaction solution by centrifuging.

6. The method of claim 1, wherein the precious metal is selected from the group consisting of platinum, palladium, silver, gold, ruthenium, osmium, iridium and rhodium.

7. The method of claim 1, wherein the precursor substance comprises a salt selected from the group consisting of $AgNO_3$, $AgClO_4$, $AgHSO_4$, $Ag_2SO_4$, AgF, $AgBF_4$, $AgPF_6$, $CH_3COOAg$, $AgCF_3SO_3$, $H_2PtCl_6$, $H_6Cl_2N_2Pt$, $PtCl_2$, $PtBr_2$, $K_2PtCl_4$, $Na_2[PtCl_4]$, $Li_2[PtCl_4]$, $H_2Pt(OH)_6$, $Pt(NO_3)_2$, $[Pt(NH_3)_4]Cl_2$, $[Pt(NH_3)_4](HCO_3)_2$, $[Pt(NH_3)_4](OAc)_2$, $(NH_4)_2PtBr_6$, $K_2PtCl_6$, $PtSO_4$, $Pt(HSO_4)_2$, $Pt(ClO_4)_2$, $H_2PdCl_6$, $H_6Cl_2N_2Pd$, $PdCl_2$, $PdBr_2$, $K_2[PdCl_4]$, $Na_2[PdCl_4]$, $Li_2[PdCl_4]$, $H_2Pd(OH)_6$, $Pd(NO_3)_2$, $[Pd(NH_3)_4]Cl_2$, $[Pd(NH_3)_4](HCO_3)_2$, $[Pd(NH_3)_4](OAc)_2$, $(NH_4)_2PdBr_6$, $(NH_3)_2PdCl_6$, $PdSO_4$, $Pd(HSO_4)_2$, $Pd(ClO_4)_2$, $HAuCl_4$, $AuCl_3$, AuCl, $AuF_3$, $(CH_3)_2SAuCl$, AuF, $AuCl(SC_4H_8)$, AuBr, $AuBr_3$, $Na_3Au(S_2O_3)_2$, $HAuBr_4$, $K[Au(CN)_2]$, $RuCl_2((CH3)_2SO)_4$, $RuCl_3$, $[Ru(NH_3)_5(N_2)]Cl_2$, $Ru(NO_3)_3$, $RuBr_3$, $RuF_3$, $Ru(ClO_4)_3$, OsI, $OsI_2$, $OsBr_3$ , $OsCl_4$, $OsF_5$, $OsF_6$, $OsOF_5$, $OsF_7$, $IrF_6$, $IrCl_3$, $IrF_4$, $IrF_5$, $Ir(ClO_4)_3$, $K_3[IrCl_6]$, $K_2[IrCl_6]$, $Na_3[IrCl_6]$, $Na_2[IrCl_6]$, $Li_3[IrCl_6]$, $Li_2[IrCl_6]$, $[Ir(NH_3)_4Cl_2]Cl$, $RhF_3$, $RhF_4$, $RhCl_3$, $[Rh(NH_3)_5Cl]Cl_2$, $RhCl[P(C_6H_5)_3]_3$, $K[Rh(CO)_2Cl_2]$, $Na[Rh(CO)_2Cl_2]Li[Rh(CO)_2Cl_2]$, $Rh_2(SO_4)_3$, $Rh(HSO_4)_3$ and $Rh(ClO_4)_3$, hydrates thereof or a mixture of salts and/or hydrates thereof.

8. The method of claim 7, wherein the precursor substance is $K_2PtCl_4$.

9. The method of claim 1, wherein the reducing agent is selected from the group consisting of ethylene glycol, hydrazine, ascorbic acid, sodium borohydride, sodium hypophosphite, lithium tetraethyloborohydride, methyl alcohol, 1,2-hexadecanediol, hydroxylamine and dimethylborazane DMAB.

10. The method of claim 9, wherein the reducing agent is ethylene glycol.

11. The method of claim 1, wherein the reagent solution comprises a solution of the precursor substance in ethylene glycol, said precursor substance being dissolved in ethylene glycol at the room or lower temperature.

12. The method of claim 1, wherein the reduction reaction is conducted at the temperature of from 70° C. to 190° C.

13. The method of claim 1, wherein the reaction solution temperature after the time t is lowered by immersing the solution in a water bath at 0° C.

14. The method of claim 1, wherein the reagent solution comprises halides, selected from the group consisting of fluorides, chlorides, bromides and iodides, and/or pseudo-halides, selected from the group consisting of cyanides, cyanates, isocyanates and thiocyanates, at a concentration higher than 5 mM, or comprises a saturated solution of halide and/or pseudohalide salts, and/or the concentration of halides in the reaction solution increases as a result of precursor substance reduction.

15. The method of claim 14, wherein the reagent solution comprises halides and or pseudohalides at a concertation of higher than 40 mM.

16. The method of claim 15, wherein the reagent solution comprises halides and or pseudohalides at a concertation of higher than 250 mM.

17. The method of claim 16, wherein the reagent solution comprises halides and or pseudohalides at a concertation of higher than 280 mM.

* * * * *